US006439408B1

(12) United States Patent
Aquino et al.

(10) Patent No.: US 6,439,408 B1
(45) Date of Patent: Aug. 27, 2002

(54) CRANE WITH JIB HAVING MULTIPLE FUNCTIONS

(75) Inventors: Francois Aquino, Pouilly sous Charlieu; Paul Laroche, Tancon, both of (FR)

(73) Assignee: Potain, Ecully (FR)

( * ) Notice: Subject to any disclaimer, the term of this patent is extended or adjusted under 35 U.S.C. 154(b) by 0 days.

(21) Appl. No.: 09/550,068

(22) Filed: Apr. 14, 2000

(30) Foreign Application Priority Data

Apr. 23, 1999 (FR) ..... 99 05408

(51) Int. Cl.[7] ..... B66C 23/42
(52) U.S. Cl. ..... 212/297; 300/227
(58) Field of Search ..... 212/296, 225, 212/226, 227, 228, 297, 300

(56) References Cited

U.S. PATENT DOCUMENTS 3,872,977 A * 3/1975 Noly ..... 212/144

FOREIGN PATENT DOCUMENTS

| | | | | |
|---|---|---|---|---|
| DE | 2408510 | * | 9/1975 | ..... 212/297 |
| DE | 26 06 799 A | | 9/1977 | |
| DE | 3516863 | * | 11/1986 | |
| DE | 26 23 299 A | | 12/1997 | |
| EP | 536061 | * | 4/1993 | |
| EP | 733584 | * | 9/1996 | |
| EP | 855361 | * | 7/1998 | |
| EP | 0 888 997 A | | 1/1999 | |
| FR | 2 260 525 A | | 9/1975 | |
| JP | 2-117591 | * | 5/1990 | |
| SU | 496225 | * | 12/1976 | ..... 212/297 |

* cited by examiner

*Primary Examiner*—Thomas J. Brahan
(74) *Attorney, Agent, or Firm*—Oliff & Berridge, PLC

(57) ABSTRACT

The crane comprises a mast (6), mounted on a chassis (1, 3), and a distributor jib (7) composed of successive elements (14, 15, 16) articulated on one another about horizontal axes (24, 29), the first jib element (14) being articulated about a horizontal axis (18) on the top of the mast (6). The first jib element (14) and, if appropriate, the following element (15) can be brought into a substantially vertical position in alignment with the erected mast (6), so as to increase the height of the mast. All the jib elements (14, 15, 16) comprise a rolling track (17) for a carriage (32), and these elements can be used in various positions (B, F). A crane with modifiable configuration is thus obtained.

17 Claims, 10 Drawing Sheets

CRANE WITH JIB HAVING MULTIPLE FUNCTIONS

The present invention relates to a lifting or handling appliance and, more particularly, to a crane which has multiple configurations and functions, especially with regard to its jib.

In the crane sector, power cranes are particularly known, the preferred use of which is the construction of buildings of parallelepipedic general shape.

The state of the art includes, in particular, power cranes with a foldable or telescopic mast, having a system for retaining the jib. A typical example of these is given in French Patent No. 91 12384/2 682 096 filed on Feb. 10, 1991 in the Applicant's name. For such cranes, it is known to produce foldable jibs in the form of a plurality of successive elements, inter alia jibs with an intermediate folding section—see, for example, French Patent No. 91 12383/2 682 097 filed on Feb. 10, 1991 in the Applicant's name.

In order to put such a crane into operation at a given location, the configuration of the crane must be predetermined before mounting or the crane must be demounted in order to change its configuration, a choice having to be made, in particular, between the following configurations:

crane with horizontal distribution jib, crane with "swanneck" distributor jib, crane with inclined distributor jib, forming, for example, an angle of 30° to 45° relative to the vertical, raisable flying jib crane.

The working bulk of the crane is determined by the selected configuration and does not make it possible to elude aerial obstacles, such as preexisting buildings, electrical lines, bridges, other nearby cranes, etc.

The bulk of the crane during the mounting of the latter is determined, in respect of a selected configuration, by the kinematics of the crane and cannot be modified.

The inoperative bulk of the crane, especially when the crane is put into the "slewing" mode, may also be large and cumbersome.

The present invention aims to avoid all these disadvantages by providing an appliance of novel design, which adapts easily and quickly to the conditions of even overcrowded work sites, by virtue of a modifiable configuration which, furthermore, allows a multiplicity of uses of the same appliance.

For this purpose, the subject of the invention is essentially a crane with jib having multiple functions, the crane comprising a mast, mounted on a chassis, and a distributor jib composed of at least two successive elements articulated on one another about horizontal axes, the first jib element being articulated by means of its rear part about a horizontal axis on the top of the mast, and all the jib elements comprising a rolling track for a carriage, this crane being defined in that a least the first jib element is capable of being brought into a substantially vertical position in alignment with the erected mast, so as to increase the height of said mast.

According to a preferred embodiment of the invention, the distributor jib of the crane is composed of three successive jib elements, namely a jib foot, an intermediate jib element and a jib tip, which are articulated on one another about horizontal axes, and the crane is intended to be capable of being used with only the jib foot brought into a substantially vertical position in alignment with the erected mast or else of being used with the jib foot and the intermediate jib element both brought into a substantially vertical position in alignment with the erected mast.

Advantageously, the mast of the crane comprises, at its top, a bearing face which is substantially horizontal and faces upward when the mast is erected and which is intended to cooperate with a complementary bearing face located at the rear of the first jib element or jib foot. The cooperation of these two bearing faces ensures that forces are transmitted when the first jib element is aligned with the erected mast.

The invention is thus defined mainly in that at least one element of the jib, preferably two jib elements, can be temporarily aligned with the mast and thus form part of this mast of which they constitute a "lengthening" piece, the other element or elements then forming a more or less shortened useful jib.

Moreover, the element or elements of the jib which are not used as mast parts may be used selectively in various configurations by virtue of the multiple joints provided, especially so as to form a horizontal distributor jib, an inclined distributor jib, a "swanneck" jib or a raisable jib. Where this last use is concerned, it is advantageous if the jib possesses at least one element which pivots about a horizontal axis located at the top of the mast or at the upper end of a jib element aligned with the erected mast, whilst the jib tip is kept in a substantially horizontal position and maintains a distributor function. The raisable jib may also be of the distributor type over its entire length and over a wide deflection angle, all the elements of this jib (which are not used as a mast part) remaining aligned.

By virtue of its particular features, the crane which is the subject of the invention makes it possible to adapt the characteristic load/range curves, more particularly for the construction of buildings of parallelepipedic shape. Moreover, the invention makes it possible to adapt the configurations of the crane to overcrowded work sites, in order to make use of normally prohibited zones and have access to zones where access is impossible for traditional lifting or handling appliances (mobile cranes, carriages with a telescopic raisable arm, site cranes). It will be noted that the working configurations of the crane which is the subject of the invention are all the more numerous and varies because the abovementioned configurations of the jib elements may be combined with variable configurations of the mast, especially if the mast is foldable or telescopic and can thus be used in several positions.

Furthermore, by virtue of its structure and its multiple positions of use, the jib of the crane which is the subject of the invention may advantageously receive, at its front end, a piece of equipment, accessory or apparatus, for example of jib lengthening piece, a pod or a fork, carried by a support which, in turn, is mounted pivotably about a horizontal axis at this end of the jib, thus further multiplying the possibilities of use of the crane.

It will also be noted that the various joints of the crane, especially those of the jib, are advantageously motorized by means of devices with jack or with jack and linkage, making it possible to change from one configuration to another easily and quickly, for example in order to bring a jib element into alignment with the mast or, conversely, in order to return this element with a position in which it belongs to the useful part of the jib.

The invention will be understood more clearly from the following description, with reference to the accompanying diagrammatic drawing which represents, by way of example, one embodiment of this crane with jib having multiple functions and which illustrates the possibilities of use of such a crane:

Figure 1:
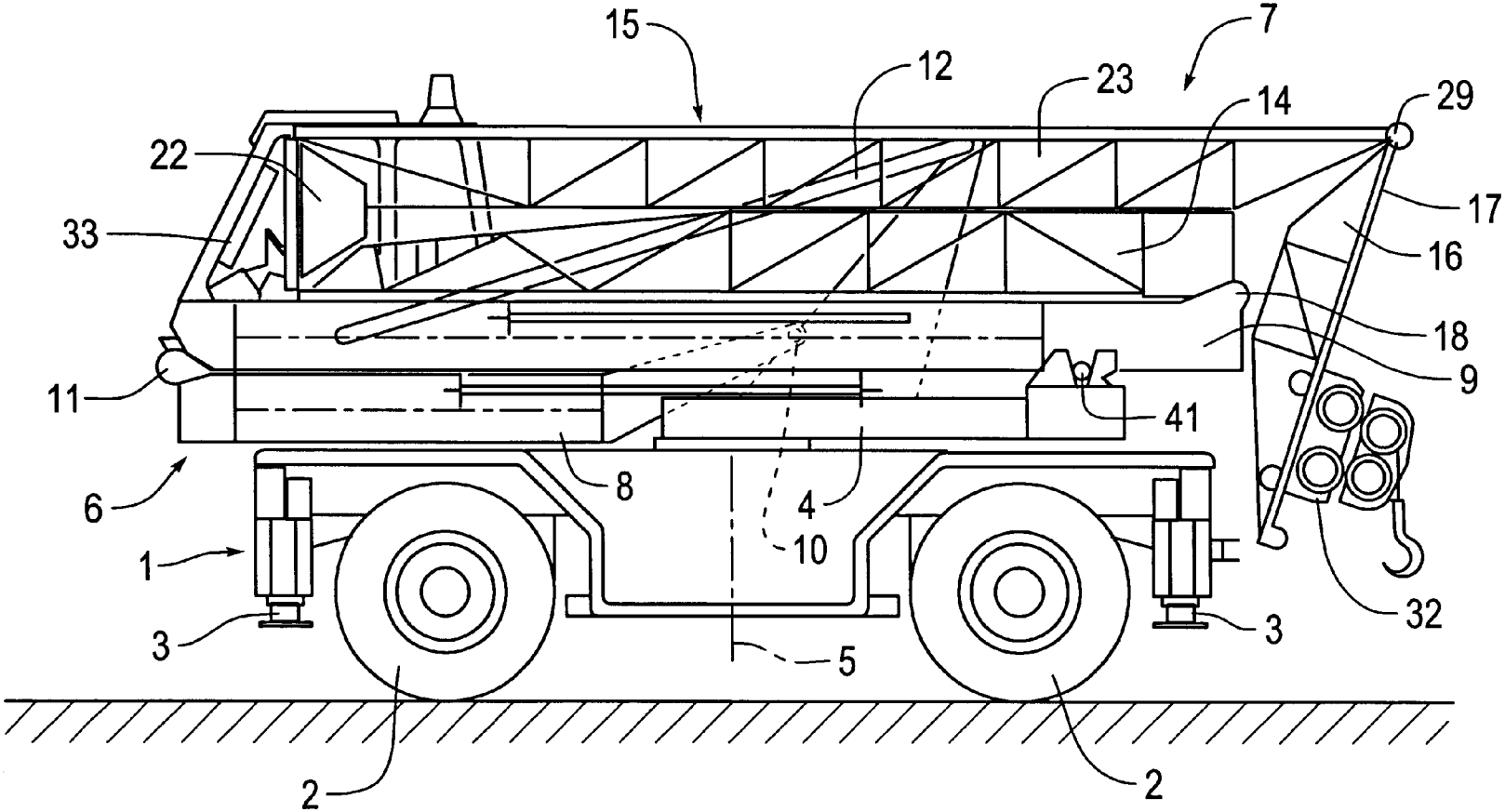
FIG. 1 is a side view of a crane according to the present invention, in a completely folded transport position.

The crane illustrated in the drawing possesses a basic chassis 1 mounted on wheels 2 and provided with stabilizers 3. Mounted on the basic chassis 1 is a rotating superstructure 4 orientable about a vertical axis 5. Mounted on the rotating superstructure 4 is a foldable mast 6 which, in turn, carries a distributor jib 7.

The foldable mast 6 is composed of two mast elements, namely a lower mast element 8 and an upper mast element 9, each of polygonal cross section and with a box structure (as illustrated) or lattice structure. The lower mast element 8 is articulated by means of its base, about a horizontal axis 10, on the rotating superstructure 4. The upper mast element 9 is articulated by means of its base, about a horizontal axis 11, on the top of the lower mast element 8, this joint allowing relative pivoting through an angle of 180°.

The foldable mast 6 is held by a double guy 12, the entire assembly being motorized by means of a device, not shown, with jack and linkage, aid device controlling the unfolding and folding of the mast 6. In the completely folded position (see FIGS. 1 and 2), the two elements 8 and 9 of the mast 6 are arranged horizontally, superposed, on the rotating superstructure 4. In this folded position, the upper part of the upper mast element 9 rests on the vertical stay with lateral guidance 41, provided at the rear of the rotating superstructure 4. In the completely unfolded position (see FIG. 3 and the following figures), the two elements 8 and 9 of the mast 6 are aligned and erected substantially vertically, with the possibility of a slight angle $\alpha$ existing between the erected mast 6 and the vertical axis 5.

The upper mast element 9 comprises, at its top, an end face 13 which, as described below, serves as a bearing face for the rear part of the jib foot.

The distributor jib 7 is composed of three successive jib elements 14, 15 and 16, each with a box structure or lattice structure, all three comprising a rolling track 17 in the region of their lower face.

The first jib element 14, also called a jib foot, is articulated at its rear end about a horizontal axis 18, on the top of the upper mast element 9, this joint allowing relative pivoting through an angle of 180°. A motorization device, with jack 19 and linkage 20, connects the upper mast element 9 to the jib foot 14, in order to control the pivoting of this jib foot 13 relative to the upper mast element 9. The jib foot 14 comprises, at its rear part, an end face 21 which serves as a bearing face, cooperating with the end face 13 of the upper mast element 9 when the jib foot 14 is aligned with this upper mast element 9.

The second jib element 15, also called an intermediate jib element, is itself composed of two sections 22 and 23.

The first section 22 of short length, called the rear folding section, is articulated by means of its rear end, about a horizontal axis 24 located in the region of the rolling track 17, on the front end of the jib foot 14. This joint, allowing relative pivoting through an angle of 180°, is motorized by means of a device with jack 25 and linkage 26.

The second section 23 of greater length, called the front section, of the intermediate jib element 15 is articulated by means of its rear end, about an axis 27 located in the region of the rolling track 17, on the front end of the first section 22. This joint, allowing relative pivoting through an angle of 90°, is motorized by means of a jack device 28.

The third and last jib element 16, also designated as a jib tip, is articulated by means of its rear end, about a horizontal axis 29 located in the region of the rolling track 17, on the front end of the intermediate jib element 15 (hence, on the front end of the second section 23 of this element 15). This joint, allowing relative pivoting through an angle of 180°, is motorized by means of a device with jack 30 and linkage 31.

The distributor jib 7 possesses a jib carriage 32 movable along the rolling track 17 and motorized by means of a winch (not illustrated) which is preferably located within the jib foot 14. The passage of the cables controlling the displacement of the carriage 32 and the lifting cable is carried out at the various joints of the jib 7 by means of cable guide pulleys (not illustrated), allowing these cables to operate in all the configurations of the jib 7.

In the exemplary embodiment illustrated in the drawing, the crane also comprises a driver's cab 33 mounted on the rotating superstructure 4 by means of a linkage 34 forming a deformable parallelogram structure motorized by means of a jack which is not illustrated. The cab 33 can thus be displaced between a low position (FIGS. 1 to 4) and a high position (FIG. 5 and the following figures).

In the folded transport position, as shown in FIG. 1, the jib 7 is folded by means of its various joints described above, in such a way that the jib foot 14 takes its place horizontally above the mast 6, itself folded, the intermediate jib element 15 has its first section 22 (rear folding section) arranged vertically and its second section 23 (front section) arranged horizontally above the jib foot 14, and the jib tip 16 is oriented vertically or obliquely downward. The jib tip 16, arranged in this way, serves for storing the carriage 32. The lowered cab 33 takes its place on one side of the assembly formed by the mast 6 and the jib 7 which are folded and laid horizontally.

Figure 2:
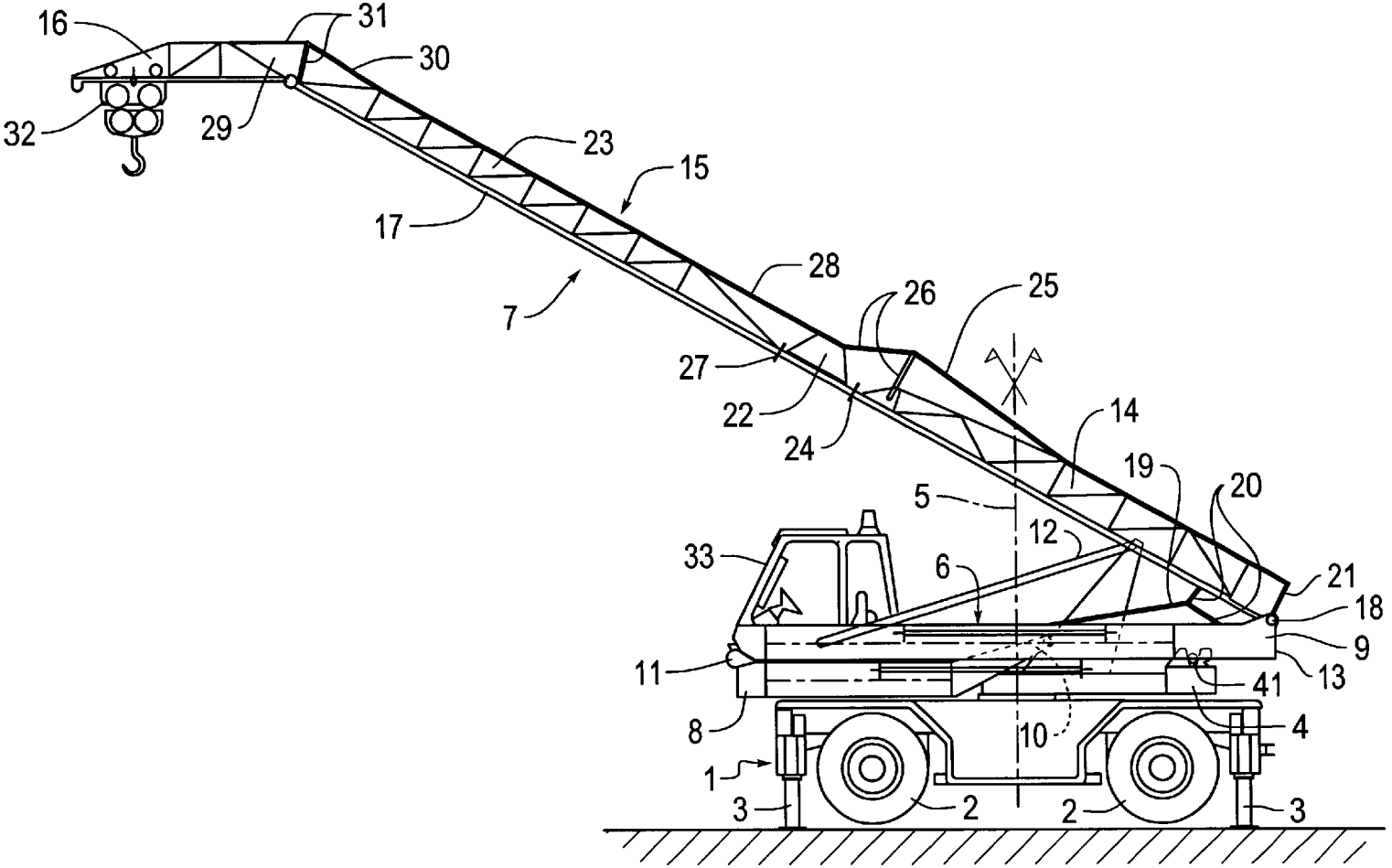
FIG. 2 is a side view of the crane of FIG. 1, used as a crane with a raisable jib, the mast remaining folded.
Figure 3:
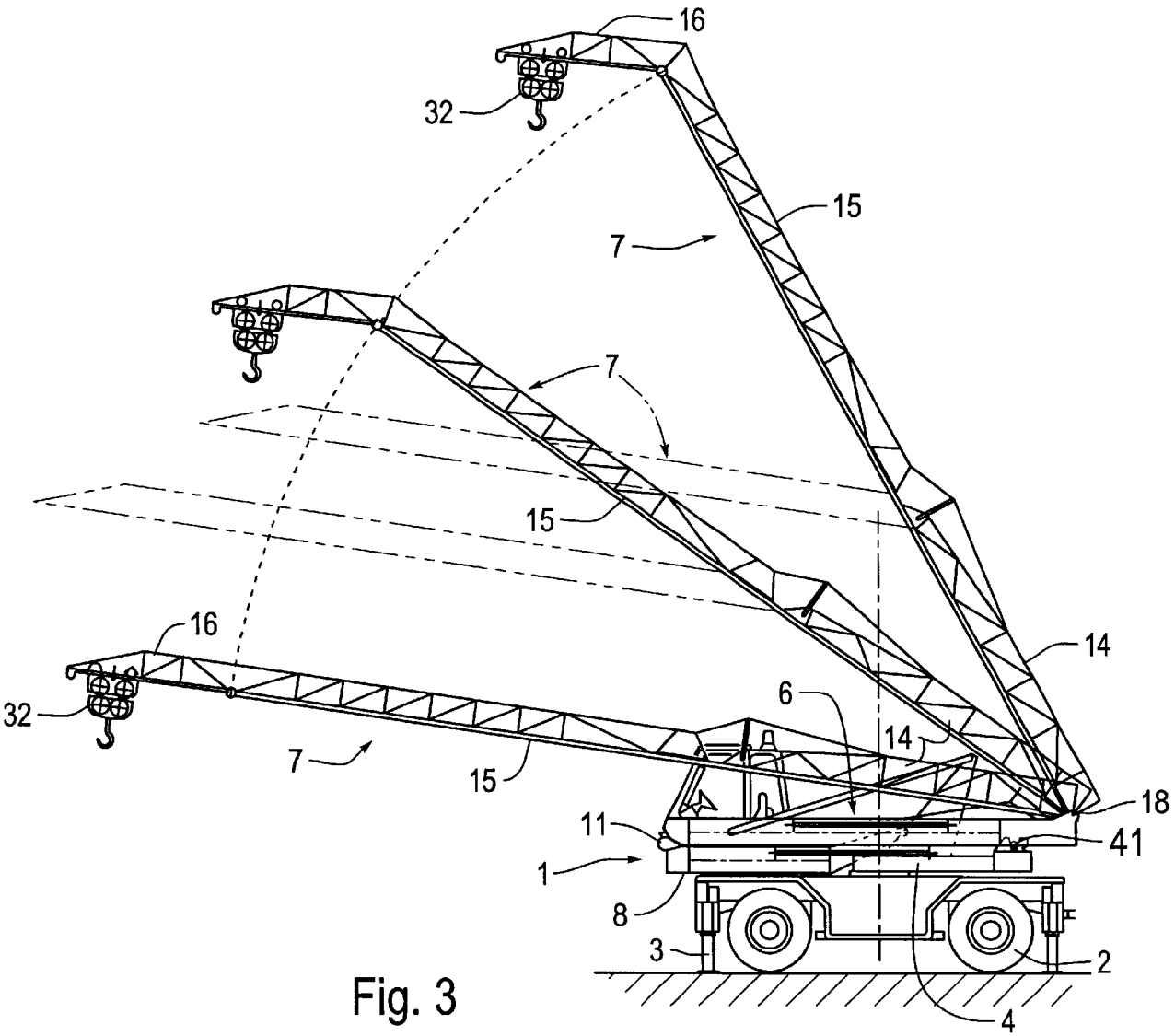
FIG. 3 illustrates various positions of use corresponding to the configuration of FIG. 2.

Starting from this completely folded position, the crane can be brought into a multiplicity of working positions, depending on the configurations which are given to the jib 7 and which may themselves be combined with a folded, partially unfolded or unfolded configuration of the mast 6. Thus, FIGS. 2 to 3 illustrate a use of this crane with its mast 6 kept completely folded (as in the transport position), FIG. 4 shows a use with the mast 6 partially unfolded, and FIGS. 5 to 8 illustrate other uses with the mast 6 completely unfolded an erected.

According to FIG. 3, the crane is used with its mast 6 completely folded, hence resting on the vertical stay 41 provided at the rear of the rotating superstructure 4, the jib 7 being used as a raisable and/or distributor jib, with various configurations (specified below).

Figure 4:
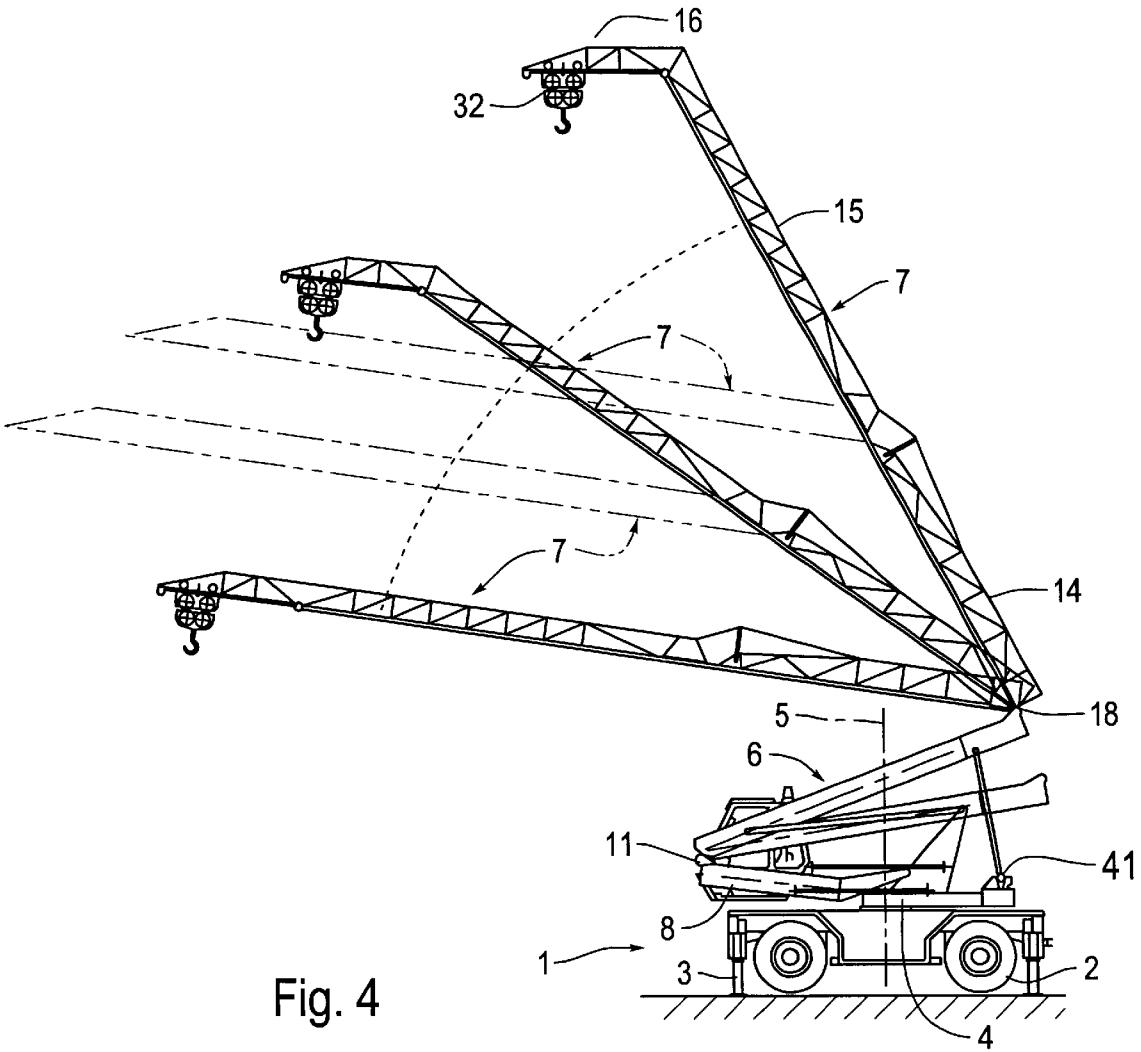
FIG. 4 illustrates other positions of use with a prop, with the mast partially unfolded.
Figure 5:
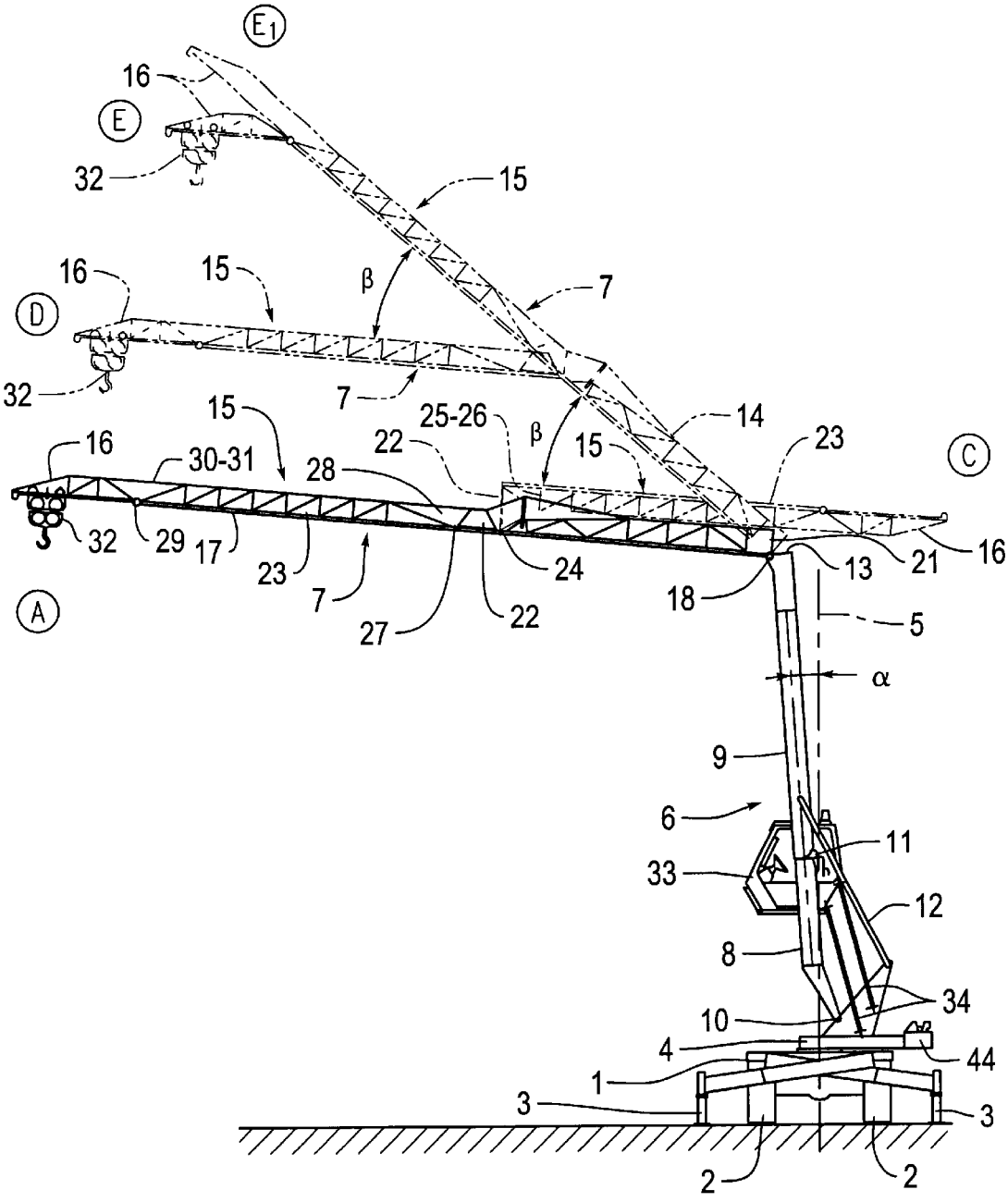
FIG. 5 is a side view of the same crane, illustrating various positions of use with the mast unfolded.

In one variant, illustrated in FIG. 4, the crane comprises an articulated or telescopic prop 42 which is mounted between the stay 41 of its rotating superstructure 4 and an element 9 of the mast 6, more particularly the head of the mast 6. In its deployed position, the prop 42 allows the crane to work with the mast 6 partly unfolded. More particularly, FIG. 4 shows various uses of the crane with the prop 42 completely deployed, and it also indicates, sketchily, a possibility of use with the prop 42 partly deployed, the mast element 9 then being nearer the horizontal. A variant with the prop having multiple positions, allowing multiple intermediate inclined positions of the mast element 9, may, of course, also be envisaged. The prop 42 may be articulated at its upper or lower end and be motorized by means of a jack, or nonmotorized.

More particularly, FIG. 4 shows a use with the jib 7 as a raisable and distributor jib on its front part (jib tip 16) and, in a variant indicated by broken lines, with the jib 7 as a "swanneck" distributor jib. Corresponding uses, but without a prop, are illustrated in FIG. 3.

According to another particular feature, one or two elements of the jib 7, specifically only the jib foot 14 or the jib foot 14 and the intermediate jib element 15, can be aligned with the partly unfolded or completely unfolded mast 6 and thus increase the height of this mast 6, thus resulting in a shortening of the useful part of the jib 7.

In particular, the crane can be used as a crane with a substantially horizontal distributor jib 7, depending on the various configurations described below:

The crane is used with a "long" distributor jib 7, the three elements 14, 15 and 16 of which are aligned substantially horizontally—see the position indicated by "A" in FIG. 5; the respective rolling tracks 17 of the three jib elements 14, 15 and 16 then come into the extension of one another, in order to form a rectilinear and continuous rolling track, along which the carriage 32 travels.

Figure 6:
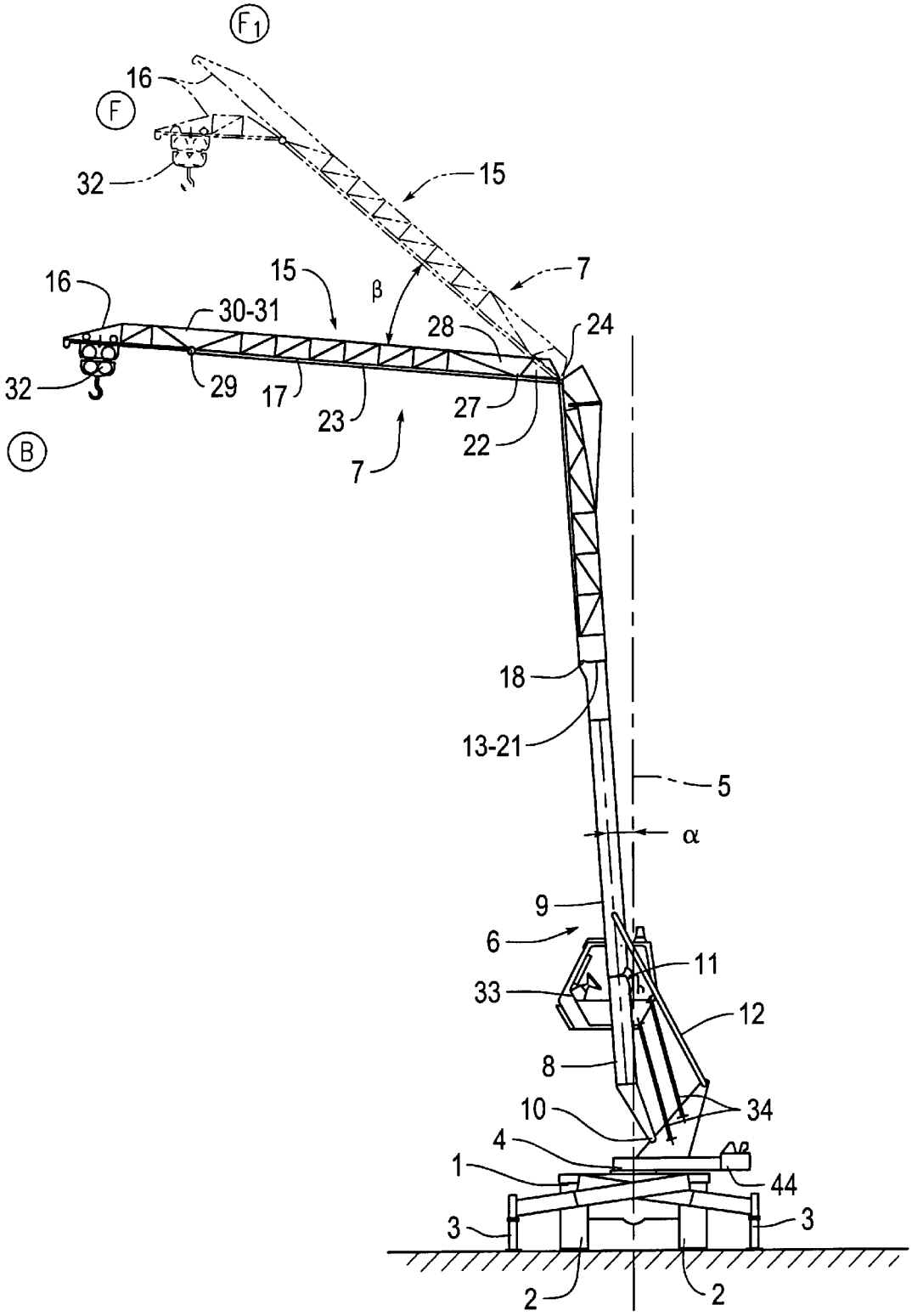
FIG. 6 is a view similar to that of FIG. 5, illustrating other positions of use with a jib element aligned with the mast.

The crane is used with a "medium" distributor jib 7, the first jib element 14 being aligned with the unfolded and erected mast 6 which it extends upward, and its second and third elements 15 and 16 being aligned substantially horizontally—see the position indicated by "B" in FIG. 6.

Figure 8:
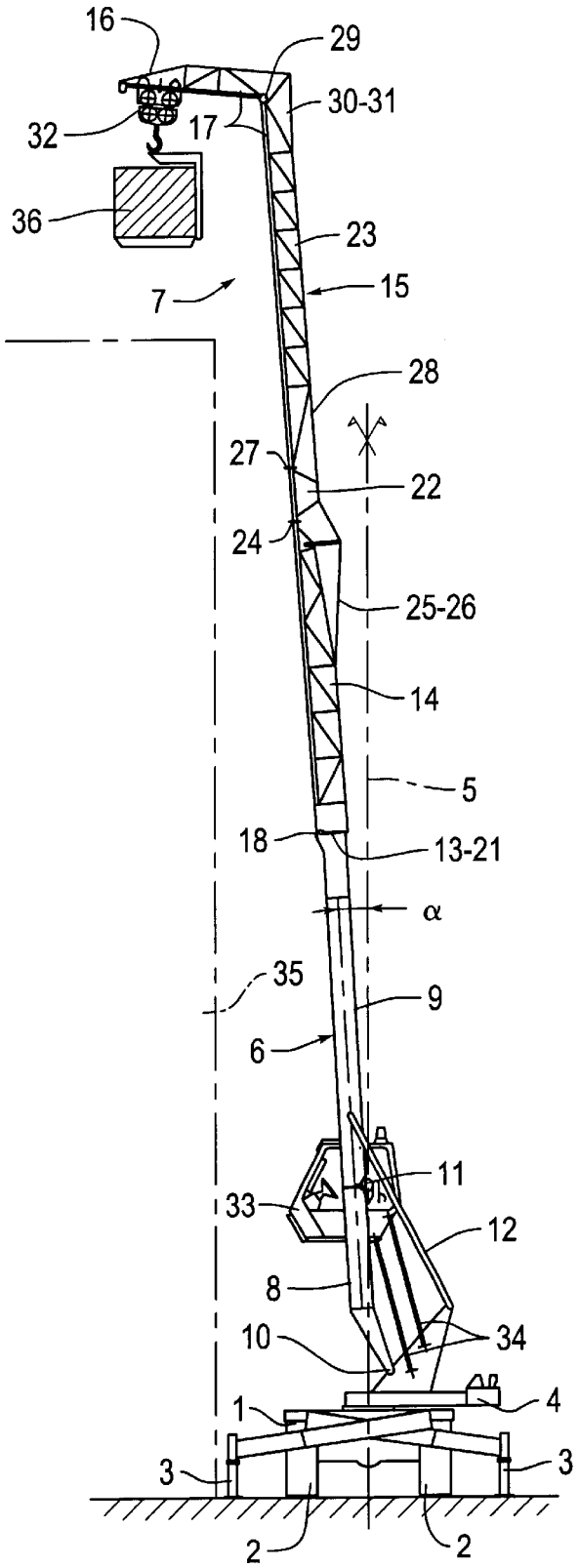
FIG. 8 is a view similar to the preceding views, illustrating yet another position with two jib elements aligned with the mast.

The crane is used with a "short" distributor jib 7, its first and second elements 14 and 15 being aligned with the unfolded and erected mast 6 which it extends upward, and only the third element 16 or jib tip being held in a substantially horizontal position—see the position illustrated in FIG. 8.

The crane is used with its jib 7 partly folded, the first jib element 14 being substantially horizontal, the first section or folding section 22 of the intermediate element 15 being oriented upward, and the second section or front section 21 of this intermediate element 15 and also the jib tip 16 being aligned and folded at 180° above the first jib element 14—see the position indicated by "C" in FIG. 5.

Starting from the configurations described above, the same crane may also be used, with a jib 7 as a raisable distributor jib 7, forming an angle, in particular, of between 0° and 45°, or even more, relative to the horizontal. This possibility can be combined with the various jib lengths capable of being used, and the resulting configurations can easily be imagined.

Another type of use is designated as a jib in "swanneck" form. In this type of use, the jib foot 14 forms an intermediate angle of between 0° and 90° relative to the horizontal, hence also relative to the mast 6. The remaining part of the jib 7, hence the second and third elements 15 and 16, are kept substantially horizontal (unless they are inclined to a greater or lesser extent). Such a swanneck jib configuration is indicated by the position "D" of FIG. 5 and in FIG. 7 (see below).

The crane can also be used as a crane with a raisable jib.

In this type of use, the carriage 32 is held on the jib tip 16 which, according to one option, can be kept in the horizontal position and maintain a distributor function. According to one possibility, the first and jib elements 14 and 15 are aligned and pivot about the horizontal axis 18 located at the top of the mast 6—see the position indicated by "E" in FIG. 5. According to another possibility, the first jib element 14 is aligned with the erected mast 6, and only the second jib element 15, with its two sections 22 and 23 aligned, pivots about the horizontal axis 24 on the top of the mast, the height of which is increased, here, by the jib element 14—see the position indicated by "F" in FIG. 6. FIG. 2 illustrates yet another use as a crane with a raisable jib, in which the aligned jib elements 14 and 15 pivot about the horizontal axis 18 held in the low position, since, here, the mast 6 remains folded. The bearing point 41 is used, here, to allow the crane to work with the mast 6 in the position laid horizontally.

Still with the crane being used with a raisable jib, according to another option the elements 14, 15, 16 of the jib 7 (which are not used as a mast part) are aligned, so that the jib 7 is a distributor jib over the entire length of these elements. This is illustrated in FIG. 5, position "E1", for a raisable jib 7 which is a distributor jib over the entire length of its three aligned elements 14, 15, 16, and in FIG. 6, position "F1", for a raisable jib 7 which is a distributor jib on its two aligned front elements 15 and 16.

Figure 7:
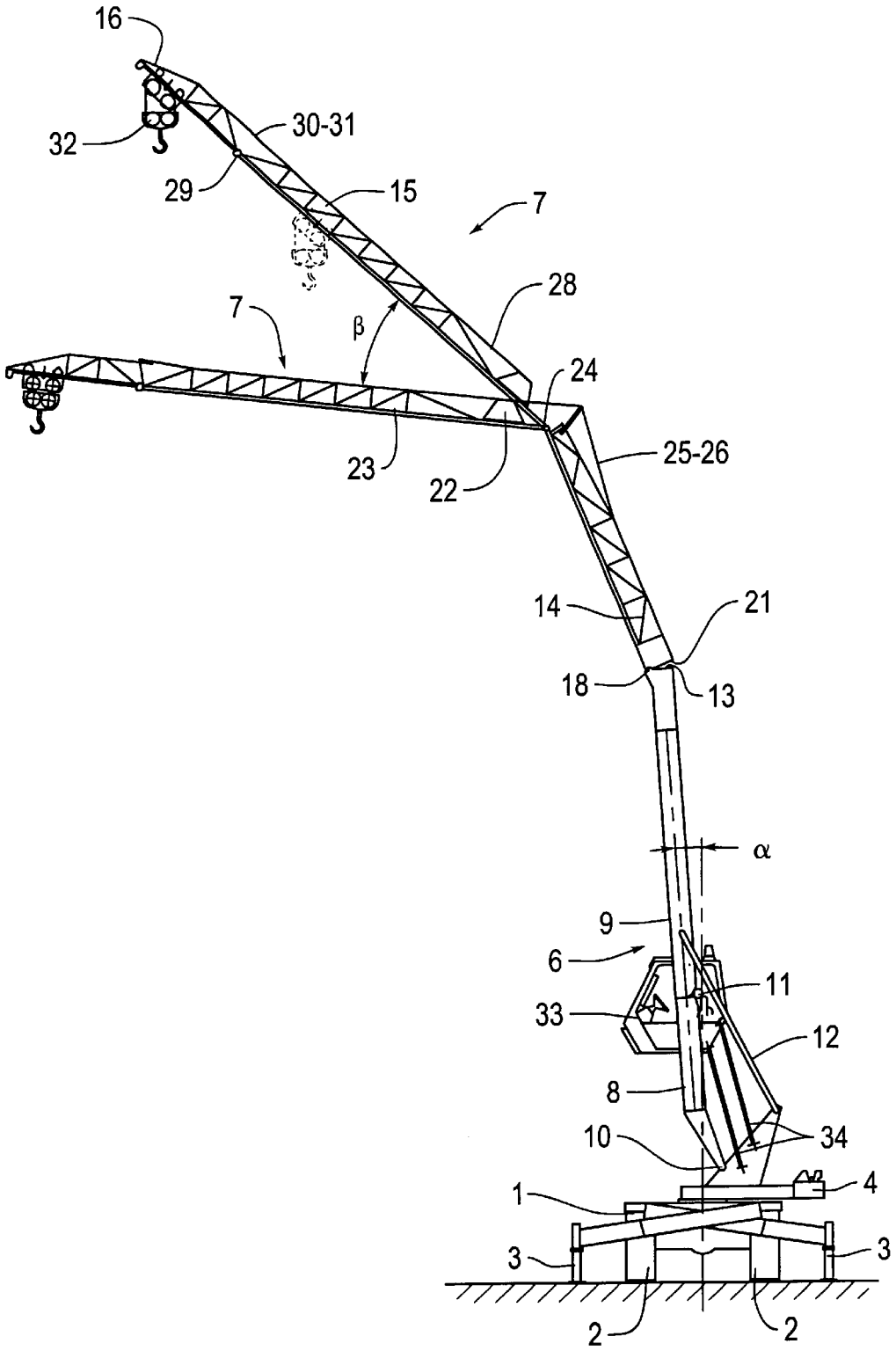
FIG. 7 is a view similar to the preceding views, illustrating a use with a raisable and/or distributor jib in "swanneck" form.

This latter option may be combined with a "swanneck", the first jib element 14 being kept inclined, as illustrated in FIG. 7.

In all the instances of a raisable distributor jib, the jib 7 (or the raisable part of this jib 7) has, been its low position and its maximum raised position, a deflection angle β which may be of the order of 45° under load (this angle may be greater when the crane is used under low load or no load).

The various configurations described above may be combined during a work cycle of the crane, for example according to the following sequences:

- change from a distributor jib 7 (unloading of a truck) to a raisable jib 7 for distributing a load on the top of a building.
- avoidance of a building 35 by the change to a position with the jib 7 and mast 6 aligned, before the return to a configuration as a distributor jib 7 for distributing the load 36 on another part of the work site (see FIG. 8).
- handling of a load through an aperture, by the combination of a raising of the mast 6 with the "swanneck" variation of the jib 7.

The jib tip 16 may be replaced, in is function as the jib end, by a simple crossmember serving as a support for the guide pulleys of the cables controlling the displacement of the carriage 32 and as a fixed point for the lifting cable, said crossmember being secured to the front section 23 of the "intermediate" jib element 15. When the crane is in the transport position, the carriage 32 is then placed on one of the sections 22 or 23 of the "intermediate" element 15.

Figure 9:
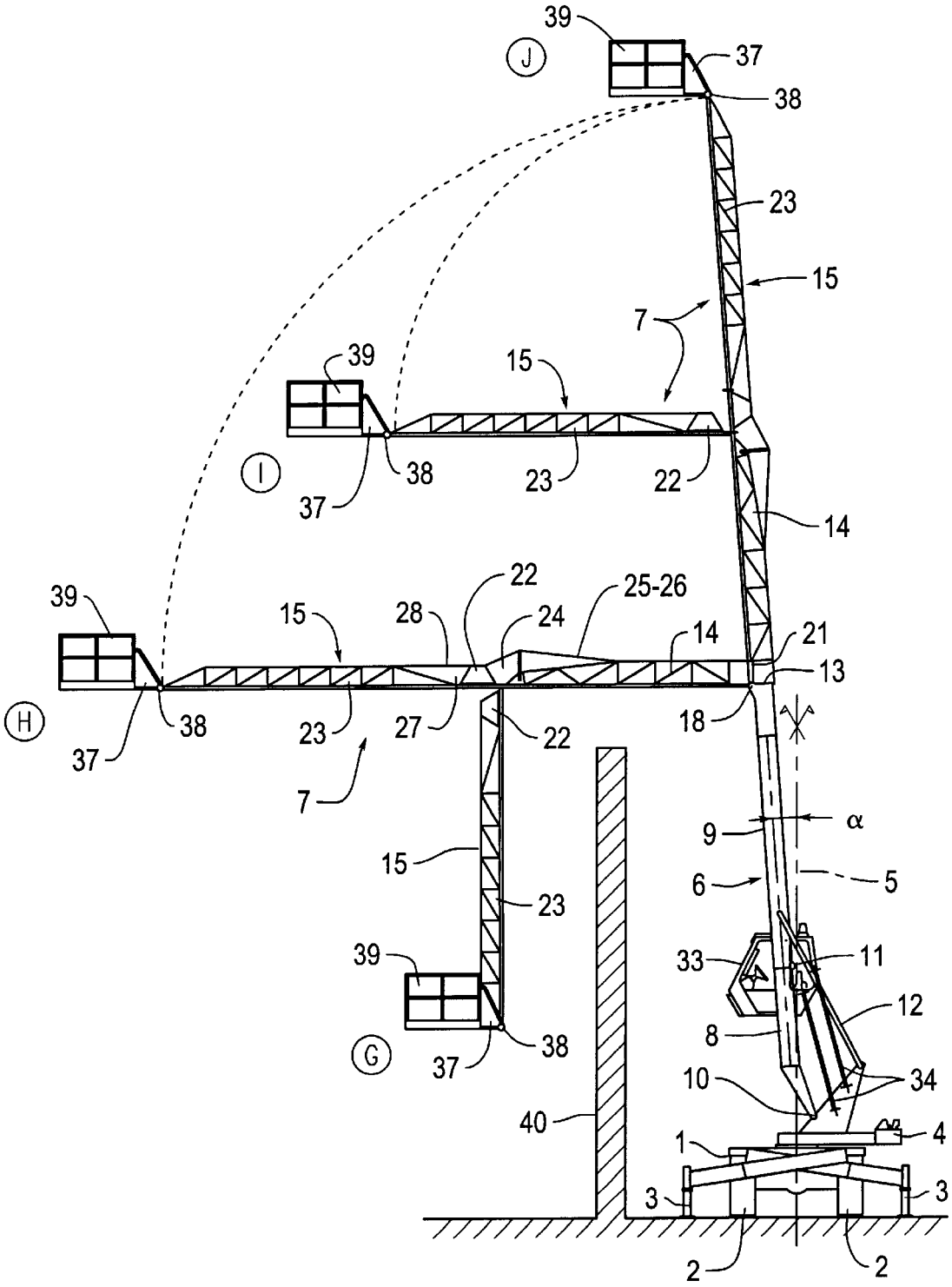
FIG. 9 illustrates, in the same side view, various positions of the crane used as a support for a pod.

If the jib tip 16 is omitted, the "intermediate" jib element 15 may receive a replacement at its front end, as shown in FIG. 9, a support 37 articulated about a horizontal axis 38 and receiving a pod 39. The articulation of the support 37 on the jib element 15 allows relative pivoting through 180°, and this joint is motorized by means of a device (not illustrated) with jack and linkage. In this application, the pod 39 can be brought into a multiplicity of working positions, such as those indicated at "G", "H", "I" and "J", using the various joints of the crane and, in particular, the possibilities already explained above for aligning one jib element 14 or 2 jib elements 14 and 15 with a mast 6, itself unfolded and erected (in the examples illustrated). In particular, in the position indicated at "G", the pod 39 can be brought into a zone separated from the basic chassis 1 by a wall 40 or other obstacle of greater or lesser height. The mast 6 could be in a folded or partially folded configuration.

Figure 10:
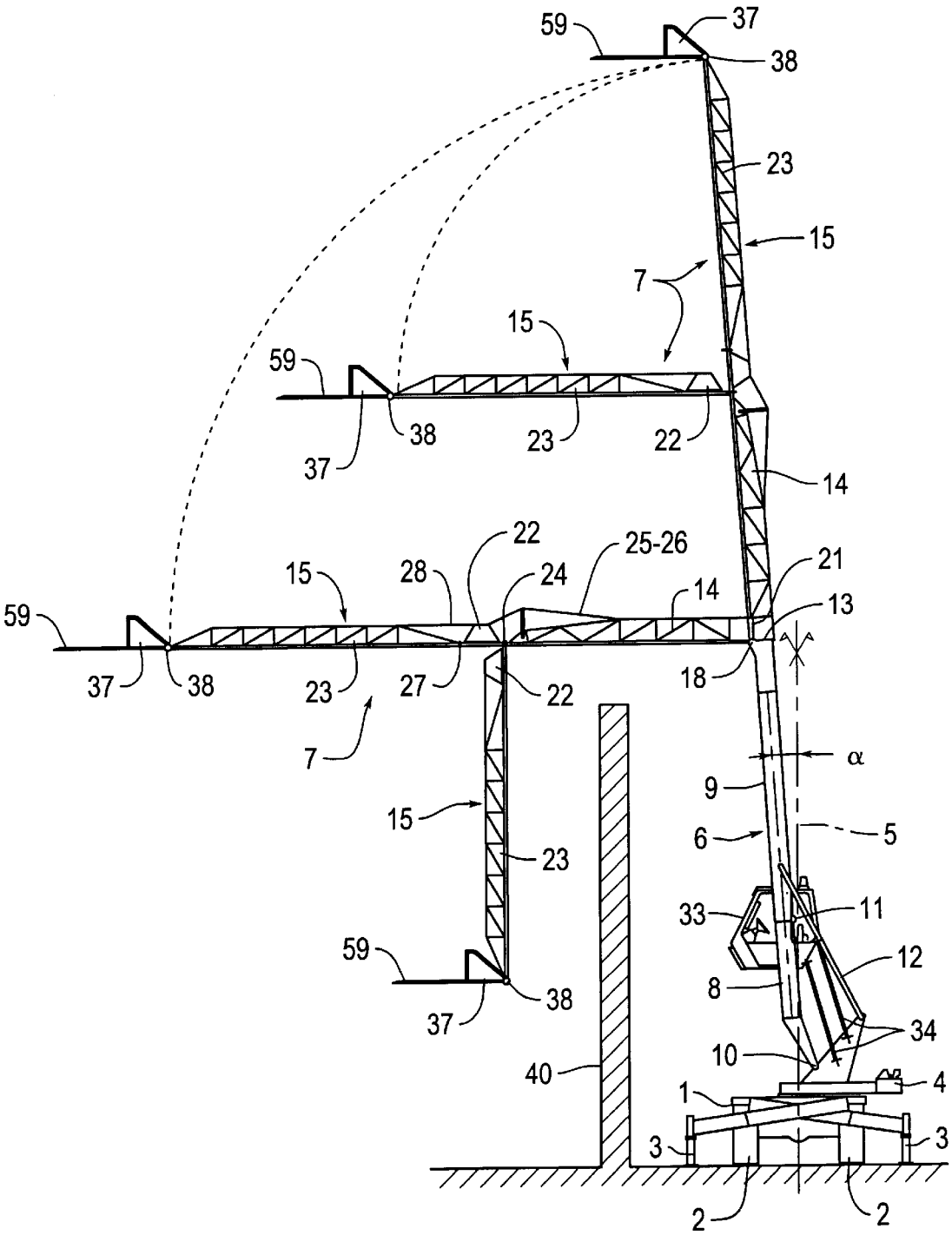
FIG. 10 illustrates, in the same side view as FIG. 9, various positions of the crane used as a support for a fork.

In variants, the support 37 may receive other pieces of equipment, accessories or apparatuses, such as a jib lengthening piece or fork 59 illustrated in FIG. 10 or a special tool, for example a bucket (not shown), allowing lifting, handling, earthworking or such like functions.

It goes without saying, by results from the foregoing, that the invention is not limited only to the embodiment and only to the uses of this crane with jib having multiple functions which are described above by way of example, but that, on the contrary, it embraces all their alternative embodiments and applications adhering to the same principle. Thus, in particular, there will be no departure from the scope of the invention:

- if the mast were produced as a single section of fixed length or as one or more telescopic sections;
- if the mast and the jib elements were produced in the form of structures of any shape and cross section, for example if the jib foot were produced as a structure of triangular cross section;
- if the number and distribution of the jib elements or sections were modified, for example if any intermediate jib element were produced as a single rigid section;
- if the motorization means associated with the various joints were replaced by any equivalents of arrangements mentioned above;
- if the same crane structure were mounted on a basic chassis or other carrying element of any type and of any shape, rolling or not;
- if any driver's cab or station different from the particular example illustrated were provided on this crane;
- if ties and struts were added, making it possible to rigidify the structure.

What is claimed is:

1. A crane with jib having multiple functions, the crane comprising:

a chassis;

at least one motorized joint, the at least one motorized joint being motorized by a device with at least one of jack and linkage;

a mast, the mast having a top, the mast mounted on the chassis; and a distributor jib; including a jib foot and at least one intermediate jib element as first and second successive jib elements, the jib foot having a rear part, the jib foot articulated by the rear part about a horizontal axis on the top of the mast, the successive jib elements including a rolling track, wherein at least one of the jib foot alone, and the jib foot and the at least on intermediate element is capable of being brought into a substantially vertical position that is axially parallel with the erected mast to increase the height of the mast, wherein the distributor jib further includes a jib tip as a third successive jib element, all successive jib elements articulated on one another about horizontal axes, wherein the jib foot is capable of being brought into various angular positions with the mast, with the mast capable of being brought into various non-vertical positions, and wherein various crane articulations, including those of the jib, are powered by at least one motorized joint and wherein the crane uses various configurations from the various crane articulations as working configurations.

2. The crane with the jib having multiple functions as claimed in claim 1, wherein the intermediate jib element includes a rear folding section of short length and a front section of greater length, making it possible to use the jib partly folded, the front section of the intermediate jib element being aligned with the jib tip and being folded at 180° above the substantially horizontal jib foot.

3. The crane with the jib having multiple functions as claimed in claim 1, wherein the mast comprises a bearing face, the bearing face located at the top of the mast, the bearing face substantially horizontal and facing upward when the mast is erected an wherein the jib foot has a complementary bearing face, the complementary bearing face located at the rear part of the jib foot, the complementary bearing face substantially horizontal and facing downward when the jib foot is aligned with the erected mast.

4. The crane with the jib having multiple functions as claimed in claim 1, wherein at least one of the successive jib elements can be used selectively to form at least one of a horizontal distributor jib, a raisable distributor jib and a jib in swanneck form.

5. The crane with the jib having multiple functions as claimed in claim 4 further comprising a jib tip as a third successive jib element, wherein, when the jib is used as a raisable distributor jib, the raisable distributor jib pivots about a horizontal axis located at a top of a mast structure, whilst the jib tip is kept in a substantially horizontal position and maintains a distributor function, the mast structure including only the mast when the jib foot is not axially parallel with the mast, the mast structure including the mast and the jib foot when the mast and only the jib foot are substantially axially parallel, the mast structure including the mast, the jib foot and the intermediate element when the mast, the jib foot and the intermediate element are substantially axially parallel.

6. The crane with the jib having multiple functions as claimed in claim 4, wherein, when used as a raisable jib, the jib is configured as a distributor jib over the entire length of all aligned jib elements that are not aligned with the mast.

7. The crane with the jib having multiple functions as claimed in claim 4, wherein the mast is foldable, the mast capable of being used in several positions, the configurations of the jib elements being capable of being combined with variable configurations of the mast.

8. The crane with the jib having multiple functions as claimed in claim 7 further comprising a rotating superstructure, the rotating superstructure having a rear, the rear having a vertical stay with lateral guidance, the mast resting in the vertical stay in a folded position to allow crane operation with the mast in a horizontally laid position.

9. The crane with the jib having multiple functions as claimed in claim 8, further comprising an articulated prop, the prop mounted between the vertical stay of its the rotating superstructure and a head of the mast allowing crane operation with the mast partly unfolded.

10. The crane with the jib having multiple functions as claimed in claim 1, wherein the jib includes a front end, the front end having a horizontal axis, the front end capable of receiving a support, the support pivotably mounted about the horizontal axis, the support capable of supporting an accessory.

11. The crane with the jib having multiple functions as claimed in claim 10, wherein the accessory is a jib lengthening piece.

12. The crane with the jib having multiple functions as claimed in claim 10, wherein the accessory is a pod.

13. The crane with the jib having multiple functions as claimed in claim 10, wherein the accessory is a fork.

14. The crane with the jib having multiple functions as claimed in claim 1, wherein the at least one motorized joint is motorized by a device with jack.

15. The crane with the jib having multiple functions as claimed in claim 1, wherein the at least one motorized joint is motorized by a device with jack and linkage.

16. The crane with the jib having multiple functions as claimed in claim 1, further comprising a carriage.

17. The crane with the jib having multiple functions as claimed in claim 16, wherein the rolling track is for the carriage.

* * * * *